US005427279A

United States Patent [19]

Kaufman

[11] Patent Number: 5,427,279

[45] Date of Patent: Jun. 27, 1995

[54] DISPENSER WITH RESERVOIR ACTUATION

[75] Inventor: John G. Kaufman, Burlington, Canada

[73] Assignee: Kaufman Products Inc., Oakville, Canada

[21] Appl. No.: 204,194

[22] PCT Filed: Jul. 2, 1993

[86] PCT No.: PCT/CA93/00258

§ 371 Date: Mar. 1, 1994

§ 102(e) Date: Mar. 1, 1994

[87] PCT Pub. No.: WO94/01032

PCT Pub. Date: Jan. 20, 1994

[30] Foreign Application Priority Data

Jul. 2, 1992 [CA] Canada ..... 2072913

[51] Int. Cl.[6] ..... B65D 37/00

[52] U.S. Cl. ..... 222/207; 222/209; 222/333

[58] Field of Search ..... 222/207, 209, 211, 333, 222/401, 457, 394, 353, 630–633, 585, 586

[56] References Cited

U.S. PATENT DOCUMENTS

| | | | |
|---|---|---|---|
| 2,609,971 | 9/1952 | Vivolo | 222/633 |
| 3,157,319 | 11/1964 | Schwienbacher | 222/207 |
| 4,018,363 | 4/1977 | Cassia | 222/207 |
| 4,222,525 | 9/1980 | Hildebrandt | 222/401 X |
| 4,324,349 | 4/1982 | Kaufman | 222/211 X |
| 4,635,828 | 1/1987 | Kaufman | 222/185 |
| 4,645,097 | 2/1987 | Kaufman | 222/207 |
| 4,917,265 | 4/1990 | Chiang | 222/207 X |
| 4,966,312 | 10/1990 | Waring | 222/211 X |
| 4,972,975 | 11/1990 | Fuhrig | 222/394 X |
| 5,033,653 | 7/1991 | Kaufman | 222/207 X |
| 5,060,830 | 10/1991 | Krall | 222/207 X |
| 5,217,147 | 6/1993 | Kaufman | 222/185 |

FOREIGN PATENT DOCUMENTS

| | | | |
|---|---|---|---|
| 2272902 | 12/1975 | France | 222/209 |
| 2653762 | 5/1991 | France | 222/211 |
| 908497 | 8/1990 | WIPO | 222/209 |

*Primary Examiner*—Kevin P. Shaver
*Attorney, Agent, or Firm*—Rogers & Scott

[57] ABSTRACT

A dispenser for liquids having a rigid container (22, 52, 74) for storing the liquid at a first level and a reservoir (24, 54, 76) below said first level providing liquid communication with the container so that some liquid at a second level in the reservoir traps the liquid in the container due to the build up of a negative pressure in the container above the first level of liquid. An outlet passageway (41, 50, 78) has an inlet positioned normally in the liquid below the second level and extending upwardly from the inlet and terminating outside the dispenser. Displacement structure (28, 56, 94) is operably coupled to the reservoir for increasing the pressure in the reservoir to thereby dispense liquid through the outlet passageway.

10 Claims, 3 Drawing Sheets

DISPENSER WITH RESERVOIR ACTUATION

DESCRIPTION

1. Technical Field

This invention relates to dispensers for liquids the dispensers being operable manually or by a suitable actuator to create an increase of pressure in the dispenser which in turn results in dispensing.

2. Background Art

Products in liquid form have for many years been packaged in a variety of containers suitable for shipping, displaying, handling and eventual sale. These containers have been made in a great variety of shapes and sizes with different types of closures. They include glass containers, and containers of synthetic plastics materials which have been molded, blow-molded and generally formed into shape. Also, because of the nature of these plastics materials, the closures can be of many various types including screw caps, flip tops, and simple bonded seals. In general, containers of these types have been made to enhance the product and little thought was given to disposing of the container.

More recently it has become common practice to recycle materials wherever possible, and there is a growing impetus to reduce the amount of packaging material used in selling products so that recycling will be minimized. As a consequence of this, there is a growing interest in selling liquid products in volume and transferring the liquid as required into a dispenser. These dispensers will be useful for a long period of time and the overall use of packaging materials will therefore be reduced.

The present dispenser fits into this arrangement and can be adapted to dispense liquid from bulk containers.

It is also expected that the marketplace will continue to need improved dispensers which are used with a product and then discarded. Dispensers according to the invention have advantages when used in this way also.

Dispensers of the present type are taught by U.S. Pat. Nos. 4,324,349, 4,635,828, 4,645,097, and 5,033,653. These dispensers have no moving parts and yet satisfy the requirements of clean dispensing with temperature conpensation to permit the dispenser to be subjected to a designed temperature range without inadvertent dripping or dispensing caused by temperature variations.

The structures shown in the applicant's earlier patents are simple, and relatively inexpensive to manufacture. The dispensers have a reservoir containing some of the liquid to be dispensed and in communication with the main part of the dispenser in the form of a container where the major volume of the liquid is contained. Air is trapped above the liquid in the container under a negative pressure which prevents the liquid flowing through the reservoir and out through a discharge passageway. When the container is deformed, the negative pressure is overcome to some extent so that liquid will flow out of the container and into the reservoir, then out via the passageway. As soon as the pressure is released, a negative pressure is created by the walls of the container returning from a deflected condition to the original condition so that air is sucked back into the passageway and the reservoir is set up in a condition of equilibrium. As the air is sucked back, liquid is cleaned out from the passageway and some of the air finds its way through the liquid to finish above the liquid in the container and some remains in the reservoir. It is the air in the reservoir which effectively provides the temperature compensation. As temperature increases, the negative pressure above the liquid in the container becomes more positive resulting in some flow into the reservoir, and liquid will consequently rise in the reservoir and displace air out of the passageway. This action can continue within a range of calculated temperature compensation.

U.S. Pat. No. 5,033,653 is an improvement over the earlier patents in which the concept of temperature fluctuation is separated as a parameter from response rate. This is achieved by providing a small opening communicating the reservoir to atmosphere so that as temperature compensation takes place equalization will result through the small opening. On the other hand, when dispensing takes place the opening is too small to allow sudden passage of air so that the flow of liquid will take place almost entirely through the passageway with the result that the response is essentially immediate.

While the structures described and claimed in Applicant's earlier patents have proven utility, it would be advantageous to provide structures which dispense from a container in the form of a rigid glass bottle or other standard container. It has been found that the flexibility of the containers used in the earlier designs are limiting to the scope of the structures.

It is an object of the present invention to provide a dispenser which can use a rigid container to hold the liquid to be dispensed.

DISCLOSURE OF THE INVENTION

In one of its aspects, the invention provides a dispenser for liquids, the dispenser comprising:

- a rigid container (22, 52, 74) for storing the liquid at a first level;
- a reservoir (24, 54, 76) below said first level providing liquid communication with the container so that some liquid at a second level in the reservoir traps the liquid in the container due to the buildup of a negative pressure in the container above the first level of liquid;
- an outlet passageway (41, 50, 78) having an inlet positioned normally in the liquid below said second level and extending upwardly from the inlet and terminating outside the dispenser; and
- displacement structure (28, 56, 94) operably coupled to the reservoir and operable to increase the pressure in the reservoir to thereby dispense liquid through the outlet passageway.

In another of its aspects the invention provides a dispenser for liquids comprising:

- a rigid container (22) for storing the liquid (48), the container having an outlet at the bottom of the container;
- a reservoir (24) coupled to the container for receiving the liquid through the outlet and normally holding some of the liquid at a level to cover the outlet thereby causing a negative pressure in the container above the liquid to retain the liquid in the container, the reservoir containing a space above said level and including displacement structure (24) operable to introduce a positive pressure into the reservoir;
- an outlet passageway (26) extending upwardly from below said level and terminating an exit (26) outside the dispenser so that actuation of the displacement structure will cause flow of liquid through the outlet passageway and out the exit thereby dispensing liquid.

In yet another of its aspects the invention provides a dispenser for liquids comprising:

a rigid container (22) for storing liquid to be discharged, the container having a bottom outlet (34);

a reservoir (24) below the container with the outlet inside the reservoir at a selected level so that when liquid surrounds the outlet, liquid is trapped in the container due to a build up in negative pressure in the container above the liquid, the reservoir being resiliently deformable over at least a portion of the reservoir so that the volume inside the reservoir can be reduced temporarily by mechanically deforming the reservoir;

an outlet passageway (41,50, 78) having an inlet inside the reservoir at about said selected level, and an exit outside the dispenser, the passageway extending upwardly from said inlet whereby upon deforming the reservoir, the pressure in the reservoir is increased sufficiently to cause liquid in the reservoir to pass through the outlet passageway and to discharge at said exit, and upon allowing the reservoir to return to an undeformed condition, air is sucked into the reservoir and into the container to prepare the dispenser for another discharge.

In still a further one of its aspects the invention provides a dispenser for liquids comprising:

a rigid container (22, 52, 74) for storing liquid to be dispensed and having a neck (32) with an opening, the neck extending downwardly;

a reservoir (24, 54, 76) containing at least some of the neck for storing some of the liquid with at least said opening immersed in the liquid;

an actuator (24, 56, 94) coupled to the reservoir and operable to pressurize the reservoir temporarily;

an outlet passageway (41, 50, 78) commencing in said some of the liquid, extending upwardly at least over a portion of the passageway, and ending outside the dispenser, whereby operation of the actuator will move liquid from the reservoir outwardly through the outlet passageway to discharge the liquid.

BRIEF DESCRIPTION OF THE DRAWINGS

These and other aspects of the invention will be better understood with reference to the drawings, in combination with the following description, in which.

BEST MODE FOR CARRYING OUT THE INVENTION

Figure 1:
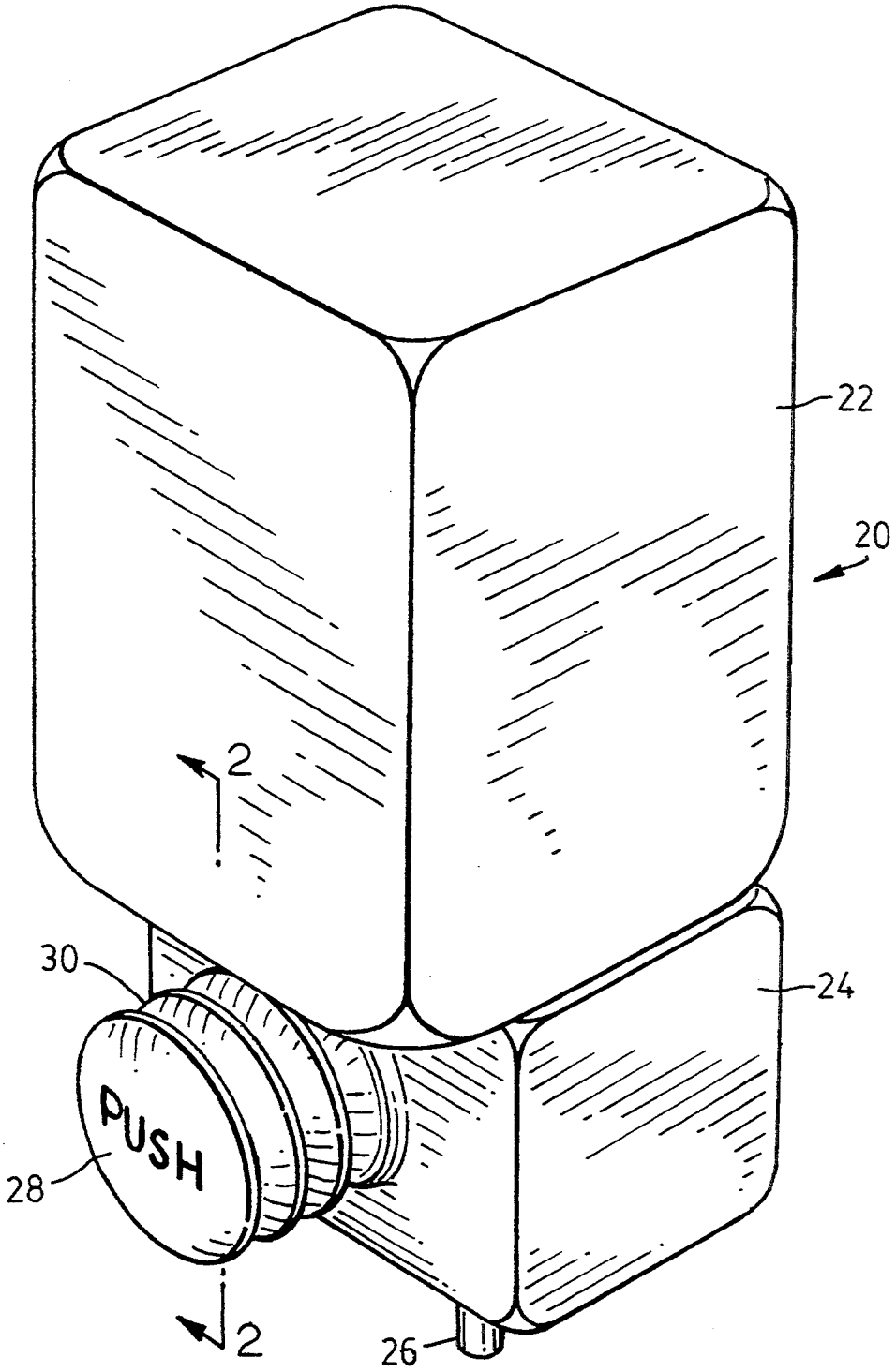
FIG. 1 is an isometric view of a dispenser incorporating the invention and designed to be operated manually.

Reference is made firstly to FIG. 1 which illustrates a preferred embodiment of dispenser for wall mounting and manual operation. The dispenser is indicated generally by the numeral 20, and includes a container 22 which holds a main portion of the liquid to be dispensed, and a reservoir 24 which normally contains a smaller portion of the liquid as it travels from the container to an outlet 26. The dispenser is operated by the user pressing on an end 28 of a bellows 30 forming a resiliently deformable part of the reservoir 24.

Figure 2:
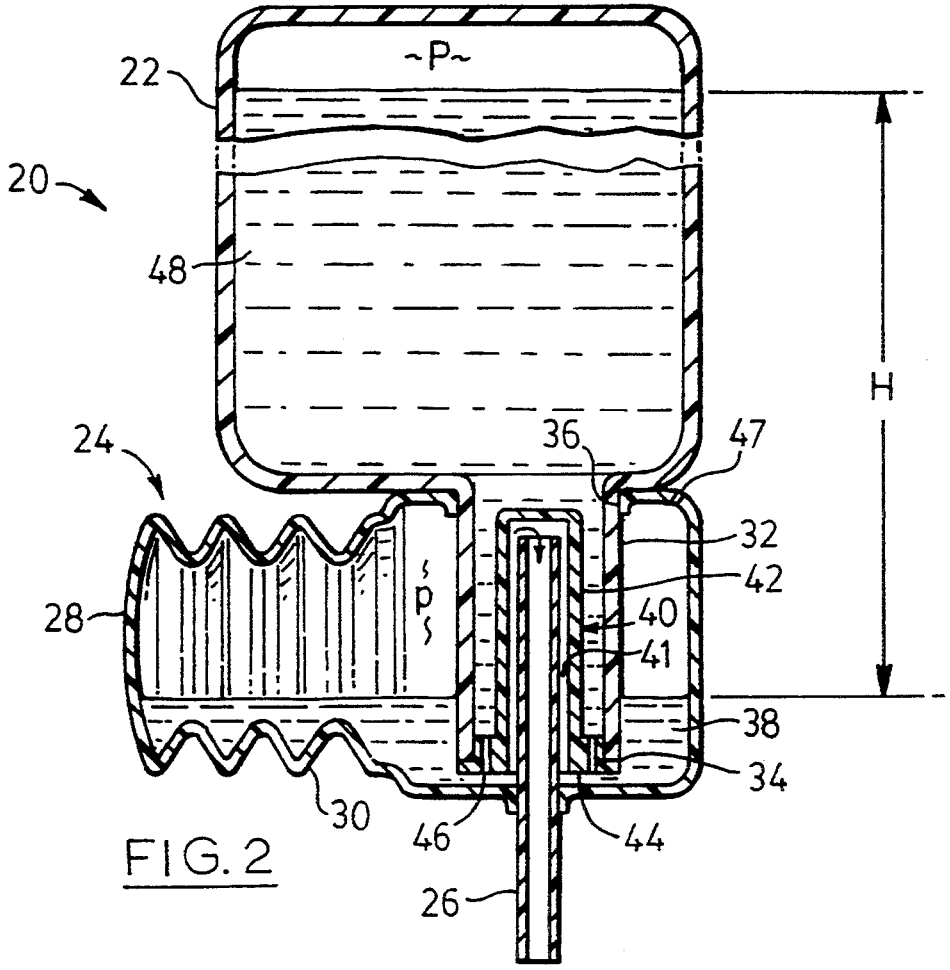
FIG. 2 is a sectional view on line 2—2 of FIG. 1.

Reference is next made to FIGS. 1 and 2 with particular reference to FIG. 2 which is a sectional view of FIG. 1. Here it will seen that the container 22 defines a downwardly extending neck 32 terminating at an open end or outlet 34. The reservoir 24 defines an opening 36 which fits closely about the neck 32 and is sealed in place. The proportions of the reservoir are such that the outlet 34 is towards the bottom of the reservoir and as will be explained, it is normally surrounded by the reservoir and by a smaller portion 38 of the liquid in the dispenser.

The neck 32 contains an insert designated generally by the numeral 40 which defines with the neck an outlet passageway 41 extending upwardly to meet the outlet 26 and to provide an outlet path for liquid from the dispenser. A closed cylindrical portion 42 extends upwardly from a radial boss 44 shaped to fit into the end of the neck 32. The boss defines a plurality of holes 46 to provide communication for liquid from the container 22 into the reservoir 24.

The outlet passageway commences upwardly from adjacent the neck outlet inside the cylindrical portion 42 and outside the tubular outlet 26. The cylindrical portion 42 is spaced from the outlet 26 to permit flow upwardly between these parts and then into the outlet 26 which extends through a suitable opening formed in the reservoir.

The reservoir 24 is also in communication with atmosphere via a small hole 47 in the wall of the reservoir. This small hole allows the space in the reservoir to receive liquid if the temperature increases because air will be displaced through its hole. However when the bellows 30 is deformed the hole is too small to permit significant air flow so that the reservoir is in effect closed above the smaller portion 38 of the liquid.

In the position shown in FIG. 2, a main portion 48 of liquid is inside the container 22 and is restricted from falling downwardly because it can not be displaced by air due to the smaller portion 38 of the liquid surrounding the neck 32. In the equilibrium or stable condition, the pressure above the liquid, i.e. "P" and the pressure "p" within the reservoir 24 is related by the following expression where "H" is the difference in height between the level of liquid in the container and the level in the reservoir: $p=HDg+P$ where "D" is the density of the liquid and "g" is the gravitational constant.

The pressure "p" inside the reservoir is equal to atmospheric pressure due to the open communication with the outlet 26 and the small hole 47. Consequently, in relative terms, $P=-HDg$.

The rigidity of the container 22 should be chosen to maintain its shape under the influence of a negative pressure within the container. Also, because the pressure within the reservoir is atmospheric, the bellows 24 can be of a light material but sufficiently resilient to return to its original shape after it is deformed to dispense liquid. Also, as shown in FIG. 2, depending upon the design, there may be some liquid within the bellows and the strength of the bellows would have to take this into consideration. Of course if the bellows were located higher than it is shown in FIG. 2, then the presence of liquid could be avoided.

As mentioned previously, when the dispenser is not in use, it may be subject to changes in ambient temperature. This will affect the negative pressure as is described in the aforementioned patents by the same applicant. An increase in temperature will result in some flow from the container to the reservoir and the liquid level in the reservoir will rise slowly. This is permitted by the very small ventilation opening 47. Similarly, if the temperature decreases, there will be a flow back into the container and again equalization is permitted above the level of liquid in the reservoir by the opening 47.

When the dispenser is to be actuated, the user deforms the bellows 30 thereby reducing the volume of the reservoir 24 and creating a pressure greater than atmospheric. There will be some flow of air through the opening 47 but this will be minor due to the very small opening (provided of course that the person pushing the bellows does so normally and not extremely slowly). This increase in pressure will change the relationship between p, H and P but because of the minimal resistance to flow in the outlet passageway, the major change will be that the level of liquid 38 will fall as most of it is dispensed through the passageway and some of it returns to the container The proportions of the reservoir and the bellows are chosen so that the user pressing the actuator or bellows 24 will bring the level down to somewhere near the bottom of the neck 32 but will not normally result in air being blown through the outlet passageway. However it is of interest to note that if the discharge is to be limited, then the proportions can be chosen so that liquid will flow through the discharge passageway followed by air if the user attempts to discharge more than a predetermined volume of discharge. Of course the an amounts discharged over a period can vary within limits due to the changes in the relationships between small p, P and H as the level of the liquid in the container drops during dispensing but nevertheless some control can be effected.

The dispenser shown in FIG. 1 is intended primarily to be positioned in the orientation shown in FIG. 1 so that some form of wall hanger or the like would be appropriate. The container 22 would be provided full of liquid and entered into the reservoir before dispensing. Alternatively, the container could be removed and refilled before being positioned in the arrangement shown in FIGS. 1 and 2.

Figure 3:
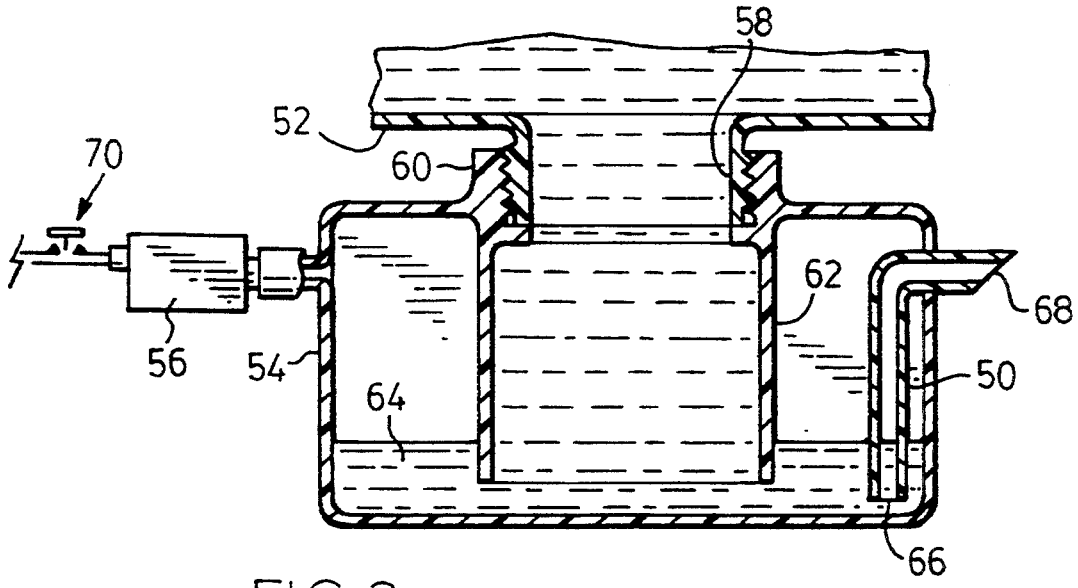
FIG. 3 is a sectional view of a portion of an alternative embodiment incorporating an actuator shown diagrammatically and for use primarily with larger volume dispensers.

In the event that it would be preferable to dispense through an outlet in the side of the dispenser, then the insert 40 and outlet 26 would be replaced by an outlet such as outlet 50 shown in FIG. 3 and to be described. Variations of this kind are all within the scope of the structure shown in FIGS. 1 and 2 provided that some form of actuation is provided in the reservoir.

Reference is now made to FIG. 3 which illustrates an alternative embodiment of dispenser made up of a rigid container 52 shown in part, a reservoir 54, the outlet 50, and an actuator 56. It is envisaged that this reservoir arrangement would be an attachment to an existing container which could be of quite large volume. The limitation is not in the volume itself but in the height indicated by H in FIG. 2. Clearly a very large value for this variable would result in a large negative pressure and would have an affect on how the system operates. By contrast, if the container is wide rather than high, then the static fluid pressures in the system would be like those shown in FIG. 2. All of this has to be taken into consideration in designing the size of the reservoir and in particular the height of the reservoir to ensure proper dispensing without inadvertent discharge.

Returning to FIG. 3, the container 52 has a threaded neck 58 to which is attached the reservoir 54 by means of an internally threaded boss 60 which seals on the neck 58. A cylindrical skirt 62 extends downwardly from the boss inside the reservoir to effectively extend the neck to a point adjacent the bottom of the reservoir. This skirt is surrounded by liquid 64 forming a smaller portion of the liquid similar to portion 38 described with reference to FIG. 2. As before, the equilibrium is set up by creating a negative pressure in the container 52 while there is an atmospheric pressure above the liquid 64 in the reservoir 54. The outlet 50 defines an outlet passageway and extends from an inlet 66 to an exit 68. As shown, the inlet 66 is below the level of the lower extremity of the skirt 62 so that in effect the opening to the container 52 lies at about the same level as the inlet 66. The relationship between these parts will become more apparent with reference to further description.

The actuator 56 can take any convenient form. For instance a small air pump operated by a switch 70 would create a positive pressure in the reservoir and cause the level of the liquid to fall as liquid both moves back into the container 52 and also dispenses through the outlet passageway in the outlet 50. If the actuator 56 continues to provide pressure inside the reservoir, then the level around the skirt 62 will drop to the point where air will start to flow around the skirt and upwardly into the container to displace further liquid which will fall into the reservoir. If the entry to the outlet 50 is sufficiently low, then liquid will continue to flow regardless of the fact that there is an interchange of air and liquid in the container 22. On the other hand, if it is desired to limit the flow through the outlet 50, then by raising the inlet 66 appropriately, a discharge of liquid will take place followed by a flow of air.

Once discharge takes place, there will be an equalization of pressure assisted by a ventilation opening 72 which like the opening 47 in FIG. 2 is a very small opening to permit temperature compensation within the reservoir while at the same time being sufficiently small that there is no significant flow through the opening when dispensing takes place.

The actuator 56, as mentioned previously, can take many forms. For instance a plunger arrangement could be used somewhat like a syringe so that although there is displacement and the volume in the reservoir is effectively reduced, there is no flow of ambient air into the reservoir. This may be desirable in circumstances where the air may not be clean.

It is also envisaged that a balloon could be used. This could be inflated and would again effectively reduce the volume in the reservoir and cause dispensing. All of these possibilities are within the scope of the word "actuator" as used in this specification.

Figure 4:
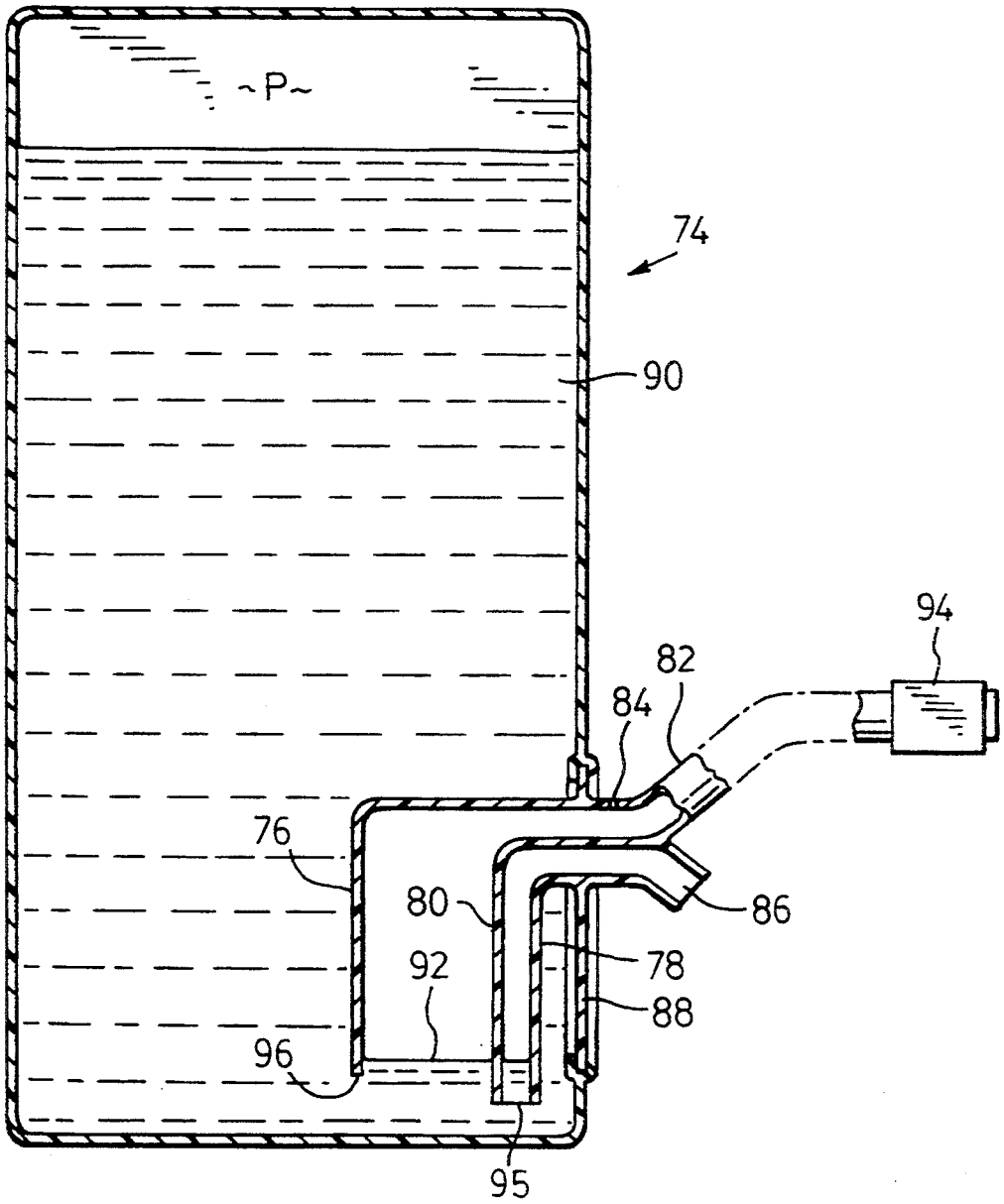
FIG. 4 is a sectional view of a further exemplary embodiment of the invention.

Reference is now made to FIG. 4 to describe a different embodiment of dispenser. A rigid container is designated generally by the numeral 74 and contains a reservoir 76 and outlet 78. The reservoir 76 and outlet 78 are of unitary construction and separated by an intermediate wall 80. At the top of the reservoir there is an inlet tube 82 having a very small opening 84 similar to openings 47 and 72 described with reference to drawings 2 and 3 respectively. The outlet 78 terminates at an exit 86 and the reservoir structure is completed by a plate 88 which is a snap fit in a suitable opening formed in the wall of the container 74. The fit is of course a seal also.

Liquid 90 to be dispensed is contained within the reservoir by a negative pressure "P" as previously described. The reservoir and outlet are at atmospheric pressure and the level of liquid in these parts is indicated by the numeral 92.

The dispenser 74 can be actuated by an actuator 94 which is operated to create a pressure within the reservoir 76 in the manner described with reference to the actuator 56 described with reference to FIG. 3.

It will be seen in FIG. 4 that the outlet 78 has an entrance 95 below an entrance 96 to the reservoir 76. As discussed previously, this relationship ensures that the outlet will continue to dispense while air is finding its way to the top of the container to displace more liquid from the container.

As soon as the actuator is disengaged, the level 92 will tend to return to the position shown in FIG. 4. The embodiment shown is FIG. 4 is of interest because the structure used to dispense is essentially added to the container but, unlike the containers described previously, there is no neck. The container would be filled through the opening provided for the plate 88 and then the structure snapped in place before placing the container in the position shown in FIG. 4.

Communication between the container 74 and the reservoir 76 is through the bottom of the reservoir and, as is the case in the previous embodiments, the control of the liquid stems from the fact that the negative pressure "P" is developed at the top of the container.

It will now be apparent that one of the characteristics of the present invention is that the container will be essentially rigid and could be a glass bottle or any other structure already in use in the market place. Structure including the reservoir and associated parts can be added to the existing bottle to make a dispenser with the bottle hanging upside down.

It is also an inherent characteristic of the present invention that there will be some inner flow back into the container during initial dispensing. Further if the proportions and actuator are chosen to do so, it is possible to cause air to flow into the container to displace liquid so that dispensing takes place. These characteristics move to distinguish the present invention from eariler inventions by applicant.

The structures shown and described are examplary of many structures which are all within the scope of the invention as claimed.

INDUSTRIAL APPLICABILITY

The dispensers described can take many forms for various uses. The bottom discharge type shown in the examplary embodiment seen in FIG. 1 can be used to dispense product such as liquid soap onto a user's hand from a wall-mounted location. Other applications would include remote dispensing using an actuator and switch such as that seen in FIG. 3 or, in a different form, in FIG. 4. Other dispensers could be lifted and squeezed and could dispense liquid food products, soaps, shampoos and the like. The uses are both domestic and institutional.

INDEX OF REFERENCE SIGNS

| | | | |
|---|---|---|---|
| 20 | Dispenser | 60 | Threaded Boss |
| 22 | Container | 62 | Cylindrical Skirt |
| 24 | Reservoir | 64 | Liquid |
| 26 | Outlet | 66 | Inlet |
| 28 | End of Bellows | 68 | Exit |
| 30 | Bellows | 70 | Switch |
| 32 | Neck | 72 | Ventilation Opening |
| 34 | Outlet | 74 | Container |

-continued

INDEX OF REFERENCE SIGNS

| | | | |
|---|---|---|---|
| 36 | Opening | 76 | Reservoir |
| 38 | Portion of liquid | 78 | Outlet |
| 40 | Insert | 80 | Wall |
| 41 | Outlet Passageway | 82 | Inlet Tube |
| 42 | Cylindrical Portion | 84 | Small Opening |
| 44 | Radial Boss | 86 | Exit |
| 46 | Holes | 88 | Plate |
| 47 | Hole | 90 | Liquid |
| 48 | Main Portion of Liquid | 92 | Liquid level |
| 50 | Outlet | 94 | Actuator |
| 52 | Container | 95 | Entrance |
| 54 | Reservoir | 96 | Entrance |
| 56 | Actuator | | |
| 58 | Threaded Neck | | |

I claim:

1. A dispenser for liquids, the dispenser comprising:

a rigid container (22, 52, 74) for storing the liquid at a first level;

a reservoir ( 24, 54, 76 ) below said first level providing liquid communication with the container so that some liquid at a second level in the reservoir traps the liquid in the container due to the buildup of a negative pressure in the container above the first level of liquid;

an outlet passageway (41, 50, 78) having an inlet positioned normally in the liquid below said second level and extending upwardly from the inlet and terminating outside the dispenser; and displacement structure ( 28, 56, 94 ) operably coupled to the reservoir and operable to increase the pressure in the reservoir to thereby dispense liquid through the outlet passageway.

2. A dispenser as claimed in claim 1 in which the container is in the form of an inverted bottle having a neck.

3. A dispenser as claimed in claim 2 in which the reservoir is located inside the container.

4. A dispenser as claimed in claims 1, 2 or 3 in which the reservoir defines a small hole (47) providing communication with atmosphere sufficient to permit slow equalization of pressure in the reservoir during changes in ambient temperature.

5. A dispenser as claimed in claim 1 in which the displacement structure includes a resilient element (30) which returns to its original shape after said actuation to thereby cause a reverse flow in the outlet passageway to clean liquid from the exit after dispensing.

6. A dispenser as claimed in claims 1 in which the displacement structure is a source of pressurized fluid (56) and which a includes switch (70) for selectively actuating the displacement structure.

7. A dispenser as claimed in claims 1, 2 and 3 in which the displacement structure is resilient to cause a reverse flow in the outlet passageway after dispensing as the displacement structure returns to the original shape of the structure thereby cleaning liquid from the exit.

8. A dispenser for liquids comprising:

a rigid container (22) for storing the liquid (48), the container having an outlet at the bottom of the container;

a reservoir (24) coupled to the container for receiving the liquid through the outlet and normally holding some of the liquid at a level to cover the outlet thereby causing a negative pressure in the container above the liquid to retain the liquid in the container, the reservoir containing a space above said level and including displacement structure (24) operable to introduce a positive pressure into the reservoir;

an outlet passageway (26) extending upwardly from below said level and terminating at an exit (26) outside the dispenser so that actuation of the displacement structure will cause flow of liquid through the outlet passageway and out the exit thereby dispensing liquid.

9. A dispenser for liquids comprising:

a rigid container (22) for storing liquid to be discharged, the container having a bottom outlet (34);

a reservoir (24) below the container with the outlet inside the reservoir at a selected level so that when liquid surrounds the outlet, liquid is trapped in the container due to a build up in negative pressure in the container above the liquid, the reservoir being resiliently deformable over at least a portion of the reservoir so that the volume inside the reservoir can be reduced temporarily by mechanically deforming the reservoir;

an outlet passageway (41,50, 78) having an inlet inside the reservoir at about said selected level, and an exit outside the dispenser, the passageway extending upwardly from said inlet whereby upon deforming the reservoir, the pressure in the reservoir is increased sufficiently to cause liquid in the reservoir to pass through the outlet passageway and to discharge at said exit, and upon allowing the reservoir to return to an undeformed condition, air is sucked into the reservoir and into the container to prepare the dispenser for another discharge,

10. A dispenser for liquids comprising:

a rigid container (22, 52, 74) for storing liquid to be dispensed and having a neck (32) with an opening, the neck extending downwardly;

a reservoir (24, 54, 76) containing at least some of the neck for storing some of the liquid with at least said opening immersed in the liquid;

an actuator (24, 56, 94) coupled to the reservoir and operable to pressurize the reservoir temporarily;

an outlet passageway (41, 50, 78) commencing in said some of the liquid, extending upwardly at least over a portion of the passageway, and ending outside the dispenser, whereby operation of the actuator will move liquid from the reservoir outwardly through the outlet passageway to discharge the liquid.

* * * * *